US010508515B2

(12) United States Patent
Watts et al.

(10) Patent No.: US 10,508,515 B2
(45) Date of Patent: Dec. 17, 2019

(54) METHOD AND APPARATUS FOR FILLING AN ANNULUS BETWEEN CASING AND ROCK IN AN OIL OR GAS WELL

(71) Applicant: CONOCOPHILLIPS COMPANY, Houston, TX (US)

(72) Inventors: Rick D. Watts, Houston, TX (US); Dianne Tompkins, Houston, TX (US); Helen Haneferd, Tananger (NO); Lars Hovda, Tananger (NO); Edvard Omdal, Tananger (NO); Hardy Hartmann Nielsen, Stavanger (NO); Lars Vedvik, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 15/898,937

(22) Filed: Feb. 19, 2018

(65) Prior Publication Data

US 2018/0171754 A1 Jun. 21, 2018

Related U.S. Application Data

(62) Division of application No. 15/042,814, filed on Feb. 12, 2016, now Pat. No. 10,087,716.

(60) Provisional application No. 62/116,653, filed on Feb. 16, 2015, provisional application No. 62/116,111, filed on Feb. 23, 2015.

(51) Int. Cl.
*E21B 33/13* (2006.01)
*E21B 36/04* (2006.01)

(52) U.S. Cl.
CPC ..... *E21B 36/04* (2013.01); *E21B 33/13* (2013.01)

(58) Field of Classification Search
None
See application file for complete search history.

(56) References Cited

U.S. PATENT DOCUMENTS

| | | | | |
|---|---|---|---|---|
| 2,030,159 | A | 2/1936 | Scott | |
| 4,330,155 | A | 5/1982 | Richardson et al. | |
| 4,862,964 | A | 9/1989 | George et al. | |
| 5,622,453 | A | 4/1997 | Finley | |
| 5,635,636 | A | 6/1997 | Alexander | |
| 7,631,698 | B2 | 12/2009 | Miller et al. | |
| 10,087,716 | B2 * | 10/2018 | Husby | E21B 33/13 |
| 2008/0110629 | A1 | 5/2008 | Belew et al. | |
| 2011/0127031 | A1 | 6/2011 | Garreton | |

(Continued)

OTHER PUBLICATIONS

International Search Report for parent case, App. No. PCT/US2016/017819, dated Apr. 21, 2016; 2 pgs.

(Continued)

*Primary Examiner* — Andrew Sue-Ako
(74) *Attorney, Agent, or Firm* — ConocoPhillips Company

(57) ABSTRACT

The invention relates to the decommissioning of hydrocarbon wells. It concerns the artificial promoting or inducing of creep in the overburden formation 3 surrounding an oil well 1, so that the formation rock 3 encroaches against the casing 5 to form a seal. This avoids the need to plug the annulus between the casing 5 and formation 3 with cement. The overburden may be caused to creep by reducing the pressure in the annulus, by applying heat to the overburden rock or by stressing the rock repeatedly to cause fatigue in the rock 3.

7 Claims, 4 Drawing Sheets

(56) References Cited

U.S. PATENT DOCUMENTS

2013/0299180 A1 11/2013 Dale et al.

OTHER PUBLICATIONS

Skjerve, Kristian M.—"Evaluation of Shale Formations as Barrier Element for Permanent Plug and Abandonment of Wells", Jun. 2013, Petroleum Geoscience and Engineering, XP055444585, 147 pgs.

Orlic, B., et al—"Numerical modeling of wellbore closure by the creep of rock salt caprocks", 2014, ARMA 14-7499, 48th US Rock Mechanics/Geomechanics Symposium held in Minneapolis, MN Jun. 1-4, 2014, XP055444938, 8 pgs.

Williams, Stephen, et al—"Identification and Qualification of Shale Annular Barriers Using Wireline Logs During Plug and Abandonment Operations", 2009, SPE/ IADC 119321 Drilling Conference and Exhibition, XP055444947; 15 pgs.

Li, Yawei, et al—"Creep Behavior of Barnett, Haynesville, and Marcellus Shale", 2012, ARMA 12-330, 46th US Rock Mechanics/ Geomechanics Symposium, Chicago, IL, Jun. 24-27, 2012,XP055444950; 7 pgs.

* cited by examiner

METHOD AND APPARATUS FOR FILLING AN ANNULUS BETWEEN CASING AND ROCK IN AN OIL OR GAS WELL

CROSS-REFERENCE TO RELATED APPLICATIONS

This application is a divisional application which claims benefit under 35 USC § 121 to U.S. application Ser. No. 15/042,814 filed Feb. 12, 2016, entitled "Method and Apparatus for Filling an Annulus Between Casing and Rock in an Oil or Gas Well," and to U.S. Provisional Application Ser. No. 62/116,111 filed Feb. 13, 2015 and to U.S. Provisional Application Ser. No. 62/116,653 filed Feb. 16, 2015, both entitled "Method and Apparatus for Filling an Annulus Between Casing and Rock in an Oil or Gas Well," incorporated herein in their entirety.

STATEMENT REGARDING FEDERALLY SPONSORED RESEARCH OR DEVELOPMENT

None.

FIELD OF THE INVENTION

This invention relates to the filling of an annular space between the steel outer casing of a hydrocarbon well and the surrounding rock during the construction phase, during the productive life or when the well is to be plugged and abandoned.

BACKGROUND OF THE INVENTION

After a hydrocarbon (oil and/or gas) well is drilled, a steel casing is run quickly into the wellbore. The casing has a smaller diameter than the wellbore and is landed as quickly as possible (for reasons of cost and hole stability, amongst others). After the casing has been installed, cement is normally pumped into the annular space between the casing and the surrounding formation (the "annulus") to seal it off and ensure that hydrocarbons to not come to the surface via the annulus. The annulus could be cemented over a relatively short (5-10 m) length of casing in order to achieve a leak off test ("LOT"), the "green light" to continue drilling. In addition, a casing or liner hanger packer is installed as a further precaution. The drilling of the overburden (the rock above the oil-bearing region) will continue like this with ever smaller casing dimensions. The length of each section is, amongst other things, a function of the rock properties.

After drilling and casing installation is finished in the overburden and the reservoir section (well construction), the well is completed with tubing before being set on production or injection. It will remain productive until it becomes uneconomic. At this point the well must be decommissioned in a way which minimizes the risk of leakage of hydrocarbons into the environment on a permanent basis. The plug and abandon (P&A) process is often described as re-establishing the cap rock (the overburden) in a manner which will ensure it can withstand reservoir pressure, again, on a permanent basis. In order to do this an effective long term barrier must be proved to exist already, or must be installed in the annulus as well as inside the casing itself. If the section in question was cemented during the well construction (proven by original reports or logging) this may be combined with an inner plug.

If the existing cement is insufficient, then the formation/annulus must be accessed in some way in order to inject cement (or another plugging material) into it, e.g. by perforating the casing using explosive or puncturing it by some mechanical means. Alternatively, the casing may be milled away entirely over some of its length to expose the formation and then a cement plug created spanning the entire wellbore. Both the outlined operations are expensive and time-consuming and both require a high capacity surface package, normally a drilling unit.

In some wells, it is believed that the formation rock in the overburden creeps after the casing is installed, possibly forming an effective natural seal between the overburden formation and the casing. However, in many wells this does not occur. The reasons for this formation creep phenomenon happening (or not happening) are not well understood.

BRIEF SUMMARY OF THE DISCLOSURE

The invention more particularly includes a process for plugging an annulus between casing and formation in a hydrocarbon wellbore by artificially promoting or inducing creep in the overburden formation surrounding the casing.

It is believed that one reason why creep does not occur in many wells may be the build-up of pressure in the annulus due to the production cement and hanger or liner packer sealing the annulus from the surface. Once a certain amount of creep has occurred, this may give rise to pressure in the annulus. Gas or oil seepage from the overburden formation into the annulus may also create pressure overlaying the liquid column in the annulus (drilling fluid and/or spacer fluid dating from the time when the well was first established).

Creep possibly could be induced by reducing the pressure in the annulus which effectively may be holding the formation in place. Some wells are set up to do this directly over a casing valve outlet. Alternatively, this could be achieved by perforating or puncturing the casing and reducing the pressure inside the casing; this would normally be achieved by reducing the so called mud weight—the density of the drilling/completion/workover fluid inside of the casing. Or there may be some other way of reducing the pressure in the annulus.

However, it is achieved, the reduction of pressure in the annulus will result in reduced "hold back force" and the well may even be operated in a so-called underbalanced mode where the pressure in the annulus/casing is lower than the formation pressure, or at least where there is a risk that this may be the case. Special surface equipment needs to be provided to manage this.

Underbalanced drilling is known and can have advantages in certain circumstances. However, plug and abandon operations are normally never conducted in underbalanced mode, since there has (until now) been no reason to risk the potential hazard. For example, in a normal perforate, wash and cement procedure during which the casing is perforated and cement placed in the annulus, an overbalance is always maintained.

It is believed that an underbalance of between 2.76 MPa (400 psi) and 27.6 MPa (4,000 psi), or optionally 4.14 Mpa (600 psi) to 13.8 MPa (2,000 psi) may be required. An underbalance in this range could be achieved by using seawater in the string. Alternatively, gas (under production) or oil could be used. In the Greater Ekofisk Area, for example, a plug is normally placed at 1554 m (5100 feet) and using seawater would result in an underbalance of approximately 7.24 MPa (1050 psi) at this depth. At a greater depth, the underbalance would be more and at a lesser depth the underbalance would be less than this.

Most materials tend to be more ductile or less strain resistant at elevated temperatures, so another option for inducing creep may be to apply heat to the formation surrounding the casing. This could be done by lowering a heating device, e.g. an electrical heater. Alternatively, simply pumping fluid can cause a temperature increase and this phenomenon could also be used to apply heat to the well formation. Heat might be applied for a period of a few minutes or for many days, but it is thought that application of heat for a short period, alone, or in combination with another creep activating technique (such as reducing annulus pressure or fatiguing the rock), would be effective. Raising the temperature of the rock above its natural temperature at a given depth by 0.5 to 50 degrees Celsius may be effective, or optionally by 0.56 to 33.33 degrees Celsius (1 to 60 degrees Fahrenheit), or optionally by 0.56 to 5.56 degrees Celsius (1 to 10 degrees Fahrenheit). Alternatively, raising the temperature by 5 to 20 degrees Celsius may be effective.

The natural temperature of the rock varies with depth and in the Greater Ekofisk Area would be expected to be about 68 degrees Celsius (155 degrees Fahrenheit) at 1554 m (5100 feet).

Creep in the formation could also be promoted or induced by stressing the formation in order to induce fatigue. For example, the annulus could be repeatedly pressurized via drilling fluid or other fluid in the annulus, either via a casing outlet valve or via holes or perforations in the casing. Alternatively, seismic equipment or similar could be used to create short wavelength cycles. Again, the effect could be transmitted to the formation through holes made in the casing or via casing valve outlets. In general, it is possible to observe fatigue effects in rock with a relatively small number of cycles, e.g. from 5 to 5,000, or optionally 5 to 500, or 10-100. Cycling the pressure over a range of plus or minus 2.76 MPa (400 psi) to 27.6 MPa (4,000 psi), or optionally 4.14 Mpa (600 psi) to 13.8 MPa (2,000 psi) may be effective.

Alternatively, the formation could be stressed or fatigued by other means such as explosives, or by direct mechanical means like a vibrating/shocking device

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
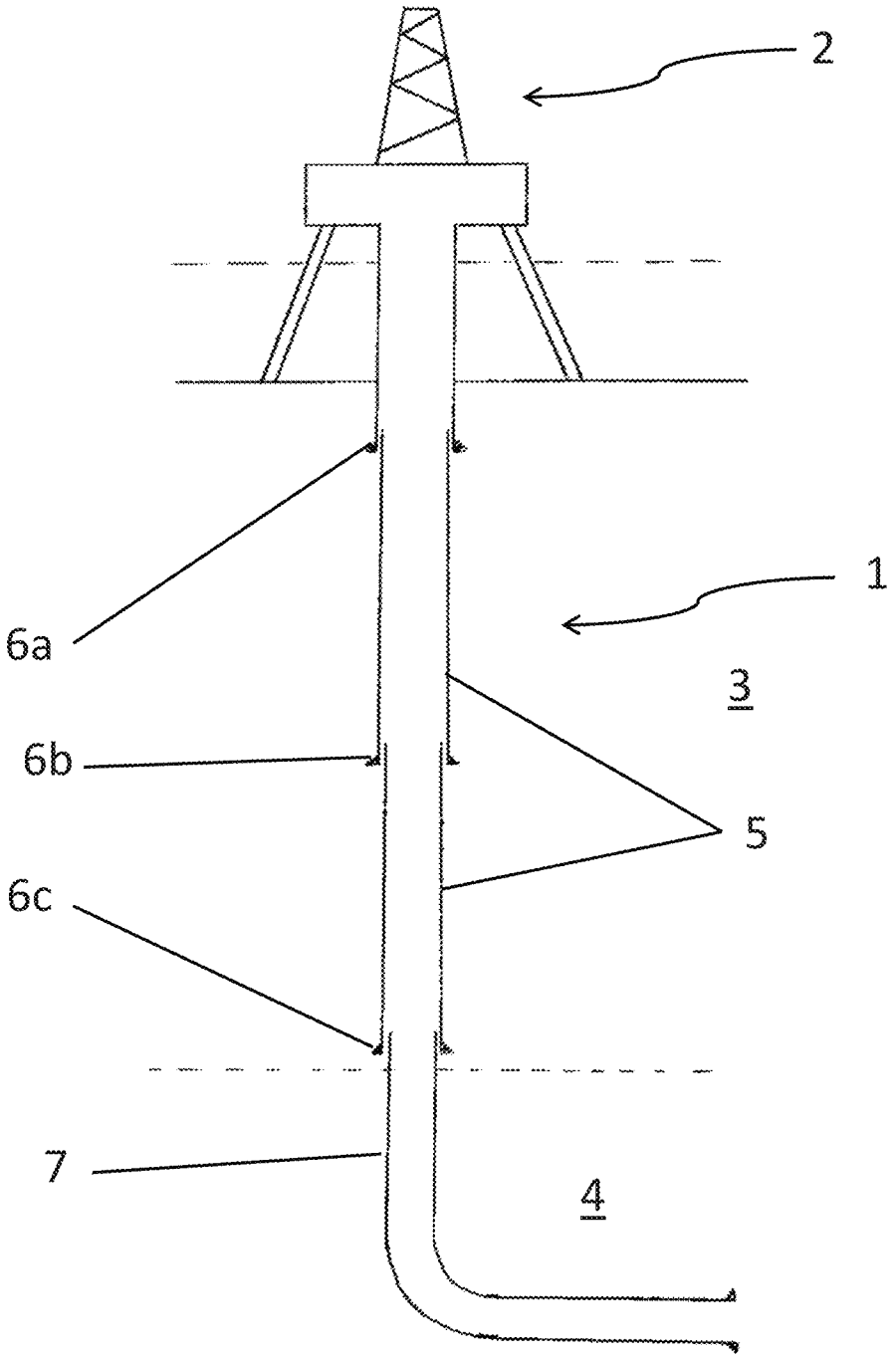
FIG. 1 is s schematic section of a hydrocarbon well.

FIG. 1 shows an entire hydrocarbon well facility including an offshore platform 2, and a well 1 extending through the overburden 3 and into the reservoir 4. In the overburden region 3, the casing 5 of the well 1 is in a number of sections of decreasing diameter, separated by casing shoes 6*a*, 6*b*, 6*c*. In the reservoir region 4 there is no casing; a production liner 7 is hung off the lowermost casing shoe 6*c*.

Figure 2:
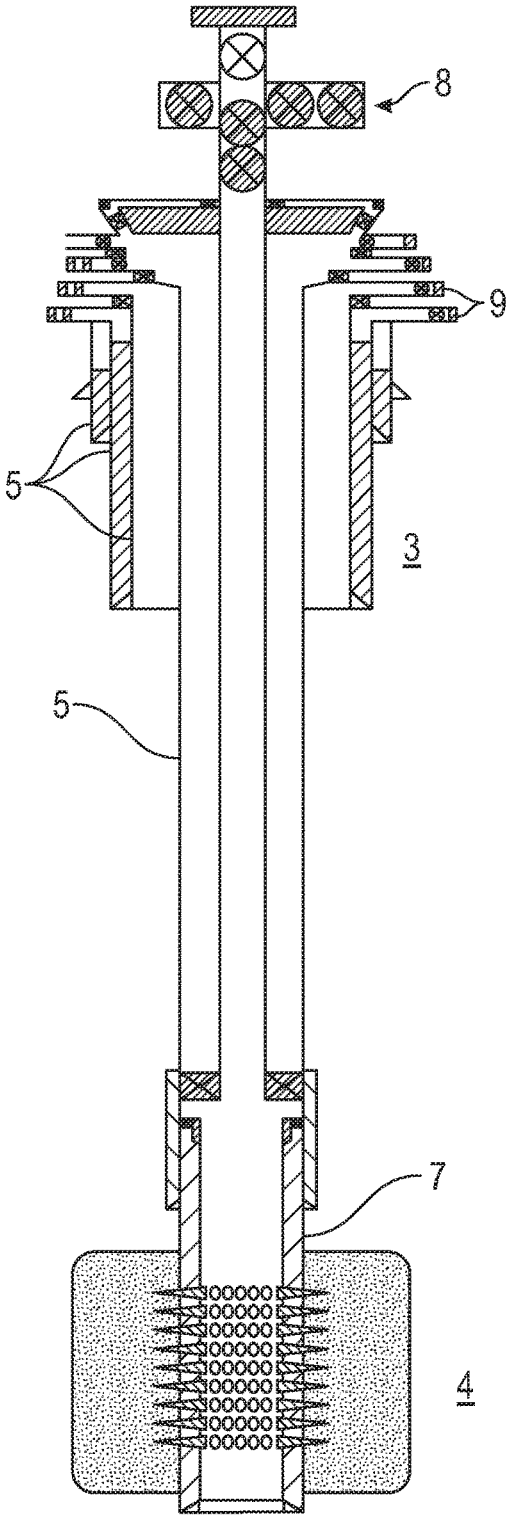
FIG. 2 is a schematic section of a producing well, showing production liner, casing and casing valves.
Figure 3:
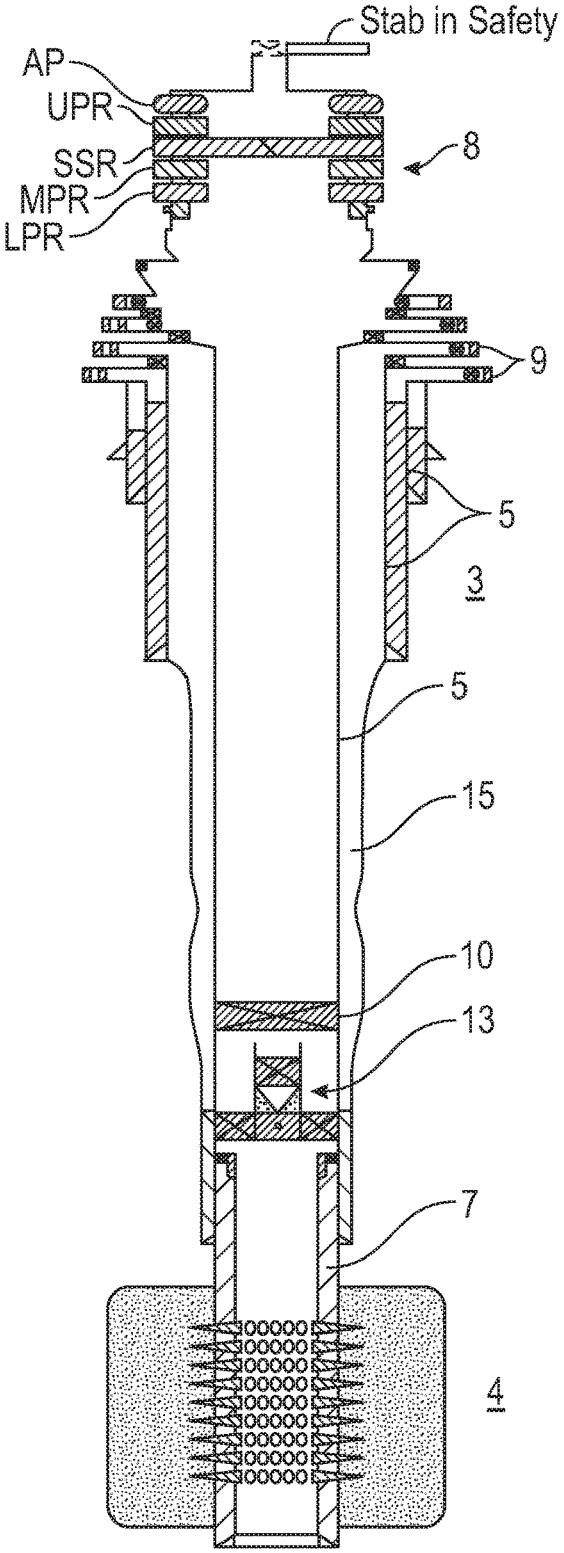
FIG. 3 is a schematic section of a well in the decommissioning stage, with access to the annulus via casing valves, suitable for a first method of inducing overburden creep.

Referring to FIG. 2, the well 1 itself, including the wellhead 8, is shown in more detail. The various diameters of casing 5 all extend to the wellhead 8 and the annuli between the various diameters of casing 5 and between casing and overburden rock 3 are sealed but accessible via casing valve outlets 9. Referring to FIG. 3, the well 1 is shown in the decommissioning stage. The Christmas tree and production tubing are removed and a packer 10 installed in the casing above the production liner 7. A first technique for controlling pressure in the annulus 15 involves accessing the annulus 15 via the casing valve(s) 9. Fluid may be produced from the outer annulus via the valve or valves 9 and the pressure maintained at a lower level than normal, in order to promote creep in the overburden formation. The pressure may be taken below that which would be expected to balance the well, that is to say keep it below the formation pressure. This may be sufficient to cause the desired creep in the overburden 3 but the pressure may also be adjusted cyclically using drilling fluid pump(s) (not shown) over a range of about 5 to 50,000 cycles (more likely at the lower end of this range such as from 5 to 500 or 10 to 100 cycles) over a range of about 2.76 MPa (400 psi) to 27.6 MPa (4,000 psi). This may have the effect of fatiguing the rock 3 by causing repeated mechanical strain, which it is believed may help to promote creep.

Figure 4:
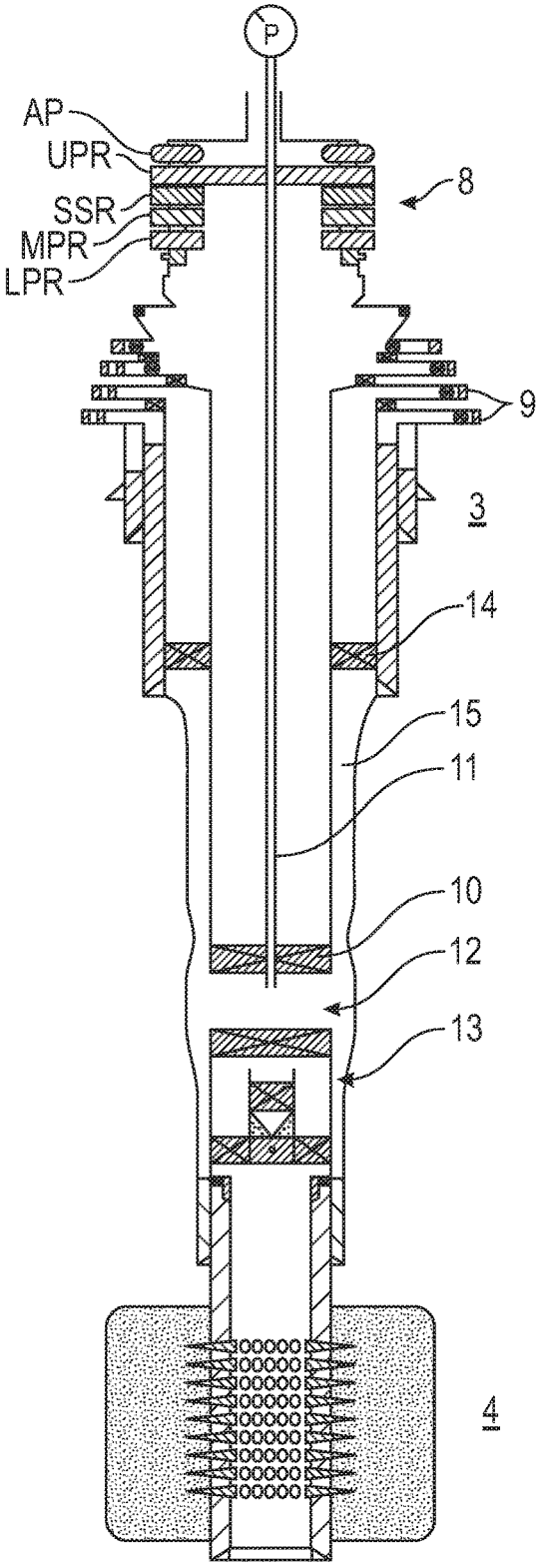
FIG. 4 is a schematic section of a well in the decommissioning stage, with coil tubing in place, for an alternative method of inducing overburden creep.

In FIG. 4 an alternative arrangement is shown where coil tubing 11 is passed down the casing 5 through the packer 10. In this well, an external casing packer 14 has previously been installed when the well was in production mode, normally at around 1554 m (5100 feet). The presence of this packer 14 means that there is no access to the annulus 15 possible via the casing valves 9. Not all wells have these external casing packers, but clearly the first described method (FIG. 3) cannot be used in these circumstances.

In this alternative method, prior to installing the coil tubing 11 a perforated or punctured region 12 is been created in the casing 5 using known techniques. Although not shown in detail in FIG. 4, normally this would be a large number of relatively small holes in the casing. The coil tubing is passed into the well to a point just above the perforated or punctured region 12. Pressure in the annulus is then managed, in ways described above with reference to FIG. 3, via drilling fluid or other fluid in the coil tubing 11. Again, pressure can be maintained at a lower than normal level to stimulate creep, or alternatively can be cycled over the ranges referred to above in order to cause fatigue in the formation and stimulate rapid creep of the formation to form a seal around the casing.

In practice, the well will have an old packer 13 and other remnants of the production phase of its life at the lower end of the casing 5 above the reservoir. In the above process, the coil tubing 11 would be passed down the casing to a point some distance above the old packer 13.

In either of the above methods, heat may be applied to the formation by an electric heater device (not shown) delivered via coil tubing. Alternatively, or in addition, it is possible to increase the temp in the well and wellbore simply by pumping/circulating fluid.

Alternatively, heating by means of an electric heater or by some chemical means may be applied in the absence of pressure cycling to promote creep in the overburden formation.

Example

Several ConocoPhillips wells in the Greater Ekofisk Area of the North Sea have recently been subject to plug and abandon operations (16 wells in the year 2015). In the majority of these no overburden swelling or creep has been observed, although conditions such as well depth, cementing, solids settling and access for logging tools vary widely between the wells. However, two of the plug and abandon candidate wells have shown formation bond (detected via logging) in an area/depth where the other agents (cement/solid settling) almost certainly cannot have been active. These two wells have been found to have damaged casing/integrity failure, causing the annulus to be in communication with the interior of the casing or other low pressure zone. The damage to the casing is evident from the presence of formation shale in the produced output, which must have entered the tubing via a breach. It is not certain when the damage to the casing occurred but it is assumed that the damage has been due to rock movement over the years that the well has been active.

In these two wells with which, unlike the others, have damaged casing, it has been observed that creep or swelling of the overburden rock has occurred such that the annulus has been closed—detected by logging. It is not clear yet to what extent a seal around the casing may have been created. The inventors believe that the observed creep or swelling of the overburden may have been caused by a reduction of pressure in the annulus due to the damaged casing.

The inventors believe this discovery lends support to the feasibility of artificially inducing creep or swelling of the overburden. More specifically, the discovery lends support to the possibility of inducing creep or swelling by artificially changing the pressure in the annulus.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for plugging an annulus between casing and formation in a hydrocarbon wellbore, comprising:

substantially equalizing pressure between the annulus and the interior of the casing;

placing the well in an underbalanced state without cycling;

artificially promoting or inducing creep in the formation surrounding the casing; and plugging the annulus between casing and formation in a hydrocarbon wellbore.

2. The process according to claim 1 which comprises perforating or puncturing the casing in order to achieve said equalization of pressure between the annulus and the interior of the casing.

3. The process according to claim 1 which comprises passing coil tubing down the wellbore in order to achieve said equalization of pressure between the annulus and the interior of the casing.

4. The process according to claim 1 wherein said equalization of pressure between the annulus and the interior of the casing is achieved via casing valve outlets in the wellhead.

5. The process according to claim 1 which comprises applying heat to the formation and wherein the temperature is elevated by between 5 and 50 degrees Celsius.

6. The process according to claim 1 which comprises stressing the formation and wherein the stressing step is repeated with the objective of fatiguing the formation.

7. The process according to claim 1 which comprises stressing the formation including directly stressing the formation using a mechanical device comprising a mechanical vibrator, a seismic vibrator, or other vibrational source.

* * * * *